United States Patent [19]

Valkama

[11] 4,192,713

[45] Mar. 11, 1980

[54] INTERMEDIATE PRESS NIP OF A PAPER MACHINE PRESS SECTION

[76] Inventor: Paavo J. Valkama, Leppäluoto B 1, 68610 Leppäluoto, Finland

[21] Appl. No.: 878,916

[22] Filed: Feb. 17, 1978

[30] Foreign Application Priority Data

Feb. 18, 1977 [FI] Finland ..... 770541

[51] Int. Cl.[2] ..... D21F 3/04

[52] U.S. Cl. ..... 162/358; 162/205

[58] Field of Search ..... 162/358, 359, 360 R, 162/205, 206, 305

[56] References Cited

U.S. PATENT DOCUMENTS

| | | | |
|---|---|---|---|
| 1,178,183 | 4/1916 | Savery, Jr. | 162/358 X |
| 1,479,265 | 1/1924 | Tompkins | 162/358 X |
| 3,268,390 | 8/1966 | Ely, Sr. | 162/358 X |
| 3,477,907 | 11/1969 | Ely, Sr. | 162/358 |
| 3,556,940 | 1/1971 | Cronin | 162/358 |
| 3,826,713 | 7/1974 | Nykopp | 162/358 X |

*Primary Examiner*—Richard V. Fisher

*Attorney, Agent, or Firm*—Steinberg and Blake

[57] ABSTRACT

A paper machine press section has an intermediate press nip defined between a pair of press rolls, a web conveying fabric in the form of a suitable felt or wire travelling between these press rolls together with a web carried thereby while engaging one of the press rolls. An endless fabric means in the form of a suitable felt or wire laps the other press roll to travel also through the intermediate press nip while engaging the web at the side thereof which is directed away from the web-conveying fabric. Thus, while travelling through the intermediate press nip, the web is compressed between the above fabrics. Immediately subsequent to the intermediate press nip, the web-conveying fabric together with the web conveyed thereby lap the press roll which engages the web-conveying fabric through an angle which is at least 5° and which preferably is in a range of approximately 7°–30°. The roll which engages the web-conveying fabric is preferably a smooth-surfaced roll, while the other press roll has a recessed water-receiving recess formed, for example, by grooves, blind bores, or the like.

2 Claims, 1 Drawing Figure

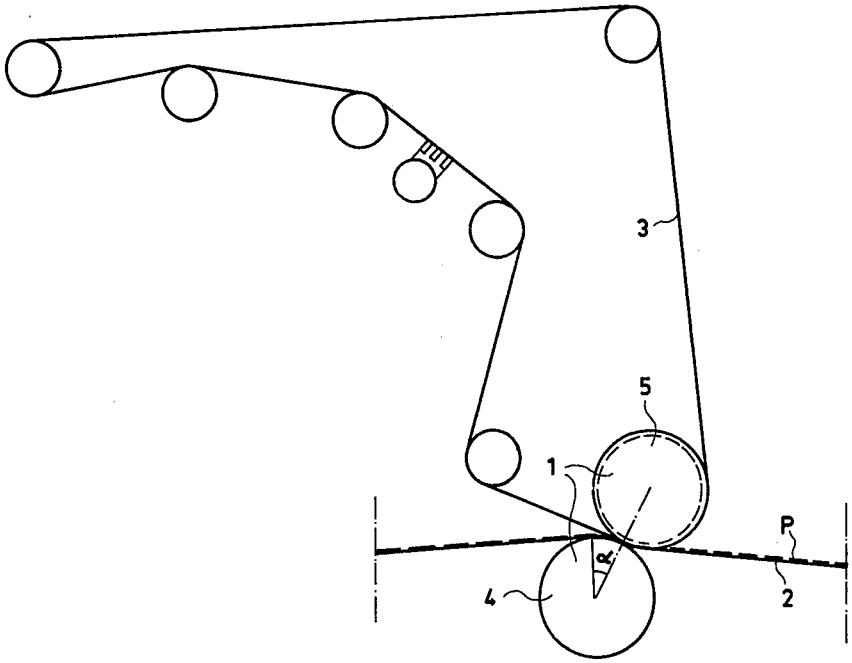
3
5
1
P
α
4
2

INTERMEDIATE PRESS NIP OF A PAPER MACHINE PRESS SECTION

BACKGROUND OF THE INVENTION

The present invention relates to part of a press section which serves to dewater a fiber web which is conveyed to and from an intermediate nip of the press section by a suitable felt or wire fabric. This intermediate press nip includes a pair of press rolls through which the above wire and fabric travel with the web adhering to the latter fabric while a second felt or wire fabric also travels through this intermediate press nip, lapping the other press roll so that at the intermediate press nip the web is compressed between the above fabrics. The press roll which engages the web-conveying fabric has a smooth surface while the other press roll is provided with a grooved surface or a surface having blind holes drilled therein, or an equivalent water-receiving recessed structure is provided. The plane which contains the axes of the above rolls is tilted with respect to the direction of travel of the web-conveying fabric in such a way that the latter fabric and the web conveyed thereby lap the smooth-surfaced press roll through a predetermined angle immediately subsequent to the intermediate press nip.

With certain press section constructions it is essential to remove water from the fiber web while this web remains continuously attached to a conveying belt or wire fabric. Such a construction is utilized, for example, when the strength of the fiber web is so small that it must necessarily be supported by a conveying wire or felt fabric while passing through the press nip. Also such a construction is desired in those cases where the fiber web has already at an earlier stage been shortened by being upset or creped in one way or another, while it is desired to avoid the tendency of the web to become elongated.

One of the practical solutions to this problem has been to provide at a press nip a suction press roll and a cooperating smooth-surfaced press roll which directly engages the fiber web. This web will of course tend to adhere to the smooth-surfaced roll, but it is maintained instead adhering to the conveying felt as a result of the suction at the suction roll. In this construction the water is removed from the web toward the suction roll through the web-conveying felt.

Another possible solution is to provide at a suction press nip of the above type an additional felt which travels between the suction roll and the web-conveying felt. With such a construction the water will then escape from the web directly through this additional felt toward the suction roll.

It is also possible to utilize double-felted press nips without a suction roll. In such constructions adhering of the web has been achieved by suitable selection of the felts in that the web-conveying felt is selected to have a smooth surface and to be more compact, or in other words of a denser construction, than the other felt. As a result the web-conveying fabric remains comparatively wet subsequent to the press nip. Various felt qualities also have an effect on the surface characteristics of the paper, giving rise to differences in smoothness or roughness. In any case, such a solution requires greater attention with respect to maintaining web adherence than would be desirable in view of other operational and quality factors.

The adherence of the web is of course assured to a greater degree if the web forming itself has taken place against the web-conveying felt. With such an arrangement the felt itself operates as part of the web-former, for example in cooperation with a wire fabric at the opposite side of the web. A construction of this type, and the further treatment of the felt-web combination thus obtained in the press section, must be viewed as a special solution which is not considered here.

SUMMARY OF THE INVENTION

A primary object of the present invention is to provide for a press section a press nip where the fiber web may be efficiently dewatered when utilizing machine speeds as are common in present day manufacturing machines, and in the manufacture of various types of paper.

It is furthermore an object of the present invention to provide a press section capable of handling a fiber web which has initially been formed at a separate former section and which has therefore a relatively low capacity for adhering to the web-conveying felt.

It is moreover an object of the present invention to provide a press section capable of operating under conditions where both felts of a double-felted press nip have the same quality and possibly are felts which have a comparatively rough surface.

A still further object of the present invention is to provide a press section the operation of which does not depend on the moisture content level of the basic felt, so that both felts may operate without the addition of water.

Yet another object of the invention is to provide a press section wherein, in addition to efficient dewatering of the web, adherence of the web to the basic web-conveying felt subsequent to the press nip is assured.

In order to obtain the above objects the press section of the invention has an intermediate press nip, situated between the first and last press nips of the press section, where the web-conveying felt immediately subsequent to the intermediate press nip laps one of the press rolls, the latter being a smooth-surfaced roll, through an angle which is not less than 5°.

Thus, with the press section of the invention, the web-conveying felt or wire fabric is urged against a smooth-surfaced press roll. A second wire or felt fabric travels through the intermediate press nip to engage the web at its surface which is opposite from the web-conveying felt, so that the web is sandwiched between these fabrics. The other press roll is a recessed roll having a grooved surface or a surface provided with blind drilled holes, or it may be a roll provided with a fabric wire. Neither of the press rolls defining the intermediate press nip cooperate with any suction assist. The direction of dewatering is away from the smooth-surface roll. The plane which contains the axes of the pair of press rolls is tilted with respect to the direction of travel of the web and fabric supporting the same so that at the exit side of the nip the felt which conveys the web, and of course the web adhering thereto, lap the smooth-surfaced press roll. In this way adherence of the web to the web-conveying felt subsequent to the nip is assured.

BRIEF DESCRIPTION OF DRAWING

The invention is illustrated by way of example in the accompanying drawing which forms part of the application and in which there is schematically illustrated in a fragmentary manner an intermediate press nip portion of a press section of a paper machine.

DESCRIPTION OF PREFERRED EMBODIMENTS

The part of the press section which is illustrated in the drawing includes an intermediate press nip situated between the first and last press nips of the press section, this intermediate press nip being defined between a pair of press rolls 4 and 5, thus providing between these rolls the illustrated intermediate press nip 1. The web P is conveyed through this intermediate press nip 1 by way of a web-conveying fabric means 2 in the form of a suitable felt or wire. Also an additional endless fabric means 3 in the form of a suitable felt or wire travels through the press nip 1, this fabric 3 engaging the surface of the web P which is directed away from the web-conveying fabric 2. Thus the web P is sandwiched between the fabrics 2 and 3 while travelling through the intermediate press nip 1. The press roll 4 which engages the web-conveying fabric means 2 is a smooth-surfaced roll. The other press roll 5 has a recessed surface formed by suitable grooves, blind drilled holes, or the like, formed in the surface of the roll 5 so that the latter can receive water from the web, and the felt 3 is dried by a suitable drying means before returning to the nip 1. Neither of the press rolls 4, 5 cooperate with any form of suction assist.

As is apparent from FIG. 1, the plane which contains the axes of the rolls 4 and 5 is tilted with respect to the direction of travel of the web 2, this angle of tilt being the illustrated angle $\alpha$ with respect to a vertical plane. Thus, at the exit side of the nip the felt 2 and the web P adhering thereto lap the smooth-surfaced press roll 4 over the angle $\alpha$. For proper operation this angle should be at least 5°. In practice, however, the angle $\alpha$ is preferably about 7°–30°, depending upon the construction of the particular recessed surface roll 5 which is utilized. The upper limit of the angle of lap $\alpha$ has no practical significance inasmuch as the felt 2 and the web P adhering thereto must be conveyed to the next press nip, so that it becomes obviously advantageous to utilize a relatively small angle of lap, but nevertheless an angle which is great enough to assure adherence of the web to the conveying fabric 2. It has been established by experiments that if the angle $\alpha$ is in the range of 7°–30°, for example, a continuous uninterrupted adhering of the web P to the conveying fabric 2, as well as a good dewatering of the web P is assured. On the other hand, if the angle $\alpha$ is less than 5°, then adhering of the web P to the conveying fabric 2 is no longer assured.

What is claimed is:

1. In a paper machine press section, an intermediate press nip including a pair of press rolls defining said nip between themselves, a web-conveying fabric means travelling between said press rolls while engaging one of said press rolls and conveying a web together with said fabric means through said nip defined between said rolls, and an additional endless fabric means lapping the other of said press rolls and travelling also through said intermediate nip while engaging the web at the surface thereof which is directed away from said web-conveying fabric means, so that the web is pressed between said web-conveying and additional fabric means while travelling through said intermediate press nip, said one press roll which engages said web conveying fabric means being a smooth-surfaced press roll while the other press roll does not cooperate with any suction assist and has a surface formed with water-receiving recesses, said smooth-surfaced press roll being located rearwardly with respect to said other press roll in the direction of travel of said web-conveying fabric means through said intermediate nip so that the plane defined by the axes of said pair of press rolls is tilted with respect to a vertical plane and such that said web-conveying fabric means together with the web conveyed thereby laps said one smooth-surfaced press roll immediately subsequent to said intermediate press nip through an angle of at least 5°.

2. The combination of claim 1 and wherein said angle is approximately in the range of 7°–30°.

* * * * *